US007003828B2

(12) United States Patent
Roussy

(10) Patent No.: US 7,003,828 B2
(45) Date of Patent: Feb. 28, 2006

(54) LEVELING SYSTEM FOR A HEIGHT ADJUSTMENT PATIENT BED

(75) Inventor: Richard B. Roussy, London (CA)

(73) Assignee: Carroll Hospital, Inc., London (CA)

( * ) Notice: Subject to any disclaimer, the term of this patent is extended or adjusted under 35 U.S.C. 154(b) by 60 days.

(21) Appl. No.: 10/875,206

(22) Filed: Jun. 25, 2004

(65) Prior Publication Data

US 2005/0283911 A1 Dec. 29, 2005

(51) Int. Cl.
*A61G 7/012* (2006.01)

(52) U.S. Cl. ..... 5/611; 5/600

(58) Field of Classification Search ..... 5/611, 5/11, 600, 616, 86.1, 81.1 R; 296/20
See application file for complete search history.

(56) References Cited

U.S. PATENT DOCUMENTS

| | | | | |
|---|---|---|---|---|
| 4,168,099 | A * | 9/1979 | Jacobs et al. | 297/325 |
| 4,233,844 | A * | 11/1980 | Dreisinger et al. | 73/379.06 |
| 4,769,584 | A | 9/1988 | Irigoyen et al. | |
| 5,105,487 | A * | 4/1992 | Hakamiun et al. | 5/689 |
| 5,161,274 | A * | 11/1992 | Hayes et al. | 5/618 |
| 5,168,591 | A * | 12/1992 | Hakamiun et al. | 5/689 |
| 5,205,004 | A | 4/1993 | Hayes et al. | |
| 5,903,940 | A * | 5/1999 | Volker et al. | 5/611 |
| 6,219,864 | B1 * | 4/2001 | Ellis et al. | 5/600 |
| 6,230,344 | B1 | 5/2001 | Thompson et al. | |
| 6,286,164 | B1 * | 9/2001 | Lamb et al. | 5/600 |
| 6,405,393 | B1 | 6/2002 | Megown | |
| 6,601,251 | B1 | 8/2003 | Paul | |
| 6,611,979 | B1 * | 9/2003 | Welling et al. | 5/624 |
| 6,634,043 | B1 | 10/2003 | Lamb et al. | |
| 6,880,189 | B1 * | 4/2005 | Welling et al. | 5/624 |
| 6,920,656 | B1 * | 7/2005 | Roussy | 5/611 |
| 2001/0047547 | A1 * | 12/2001 | Paul | 5/611 |
| 2003/0172459 | A1 | 9/2003 | Roussy | |
| 2004/0074003 | A1 * | 4/2004 | Bannister | 5/616 |

FOREIGN PATENT DOCUMENTS

| | | |
|---|---|---|
| CA | 2055672 | 5/1992 |
| CA | 2055671 | 8/1992 |
| WO | WO 96/05542 | 2/1996 |
| WO | WO 2004080363 A2 * | 9/2004 |

OTHER PUBLICATIONS

"Actuator LA31 Careline", Linak LA31 product specifications by Linak.

* cited by examiner

*Primary Examiner*—Robert G. Santos
(74) *Attorney, Agent, or Firm*—Raggio & Dinnin, P.C.

(57) ABSTRACT

A system for maintaining a height adjustable patient bed in a level position while adjusting height of the bed is provided. The system has electrically powered linear actuators having internal position sensors, the linear actuators operable to adjust the height of the bed. The system also has control means, electrically coupled to the linear actuators, which compares position information from the internal position sensors and then adjusts the power supply to one or the other of the linear actuators in response to the position information. This permits the trailing linear actuator to catch up to the lead linear actuator to maintain the bed in a level position while the height of the bed is being adjusted. Since the internal position sensors work on small changes in position, the leveling effect is not noticeable leading to less tilt of the bed and a smoother motion during height adjustment of he bed.

18 Claims, 3 Drawing Sheets

LEVELING SYSTEM FOR A HEIGHT ADJUSTMENT PATIENT BED

FIELD OF THE INVENTION

The present invention relates to patient beds, particularly to height adjustable patient beds for healthcare facilities, such as hospitals and long-term care facilities. In particular, the present invention relates to a system for maintaining a height adjustable patient bed in a level position while adjusting the height of the bed.

BACKGROUND OF THE INVENTION

Patient beds in healthcare facilities are designed so that various parts of the bed can adopt a number of positions to provide for greater patient comfort and/or to facilitate the tasks of an attendant, for example a nurse. For example, beds may be raised or lowered to different heights. Beds may be tilted to achieve the Trendelenburg and reverse Trendelenburg positions. Beds may comprise patient support platforms having back rests and/or knee rests that can be raised or lowered to support a patient's back and knees in a variety of positions.

Adjusting the height of a patient bed may be accomplished by a variety of means. One particularly advantageous method is through the use of linear actuators, for example as described in U.S. Patent Publication 2003/0172459 published Sep. 18, 2003, the disclosure of which is herein incorporated by reference. In such a bed, the head end and the foot end of the bed are raised or lowered through the use of separate linear actuators. One linear actuator operates a first set of pivotable legs for adjusting the height of the head end of the bed while another linear actuator operates a second set of pivotable legs for adjusting the height of the foot end of the bed. However, since the two linear actuators operate separately, there is a tendency for one end of the bed to lag behind the other, thereby causing the bed to acquire a tilt. This problem is exacerbated when there is unequal loading on one end as opposed to the other end of the bed since the linear actuator at the end with greater loading must work harder to adjust the height of that end.

A number of methods have been used to mitigate against this problem. For example, limit switches or stops may be used on the bed to deactivate the lead linear actuator at pre-set intervals to provide time for the other to catch up. However, the necessarily wide spacing of such limit switches still results in significant and noticeable tilting of the bed between intervals. As well, motion of the bed during height adjustment is noticeably fitful and uneven.

U.S. Pat. No. 5,205,004 issued Apr. 27, 1993 to Hayes et al. describes the use of an external level sensor connected to actuators so that if the tilt of the bed varies from the adjusted and desired position, one or the other actuator is adjusted to restore the desired tilt position. This system has several drawbacks. Since the sensor is located externally from the actuators, it can get in the way of normal bed operation and may be subject to physical damage. Furthermore, external sensors described in this patent lack sensitivity and lead to noticeable tilt and fitfulness during height adjustment of the bed.

Finally, it has even been suggested in the art to use very powerful linear actuators, which are not affected by the load on the bed. However, this has proven to be practically not possible as all actuators have load restrictions. In any event, such very powerful actuators would be overly expensive and would have larger power requirements.

There is still a need in the art for a simple, reliable system for leveling a bed with little noticeable tilt and greater smoothness of operation during height adjustment of the bed.

SUMMARY OF THE INVENTION

According to an aspect of the present invention, there is provided a system for maintaining a height adjustable patient bed in a level position while adjusting height of the bed, the system comprising: a first electrically powered linear actuator having a first internal position sensor, the first linear actuator operable to adjust height of a head end of the bed; a second electrically powered linear actuator having a second internal position sensor, the second linear actuator operable to adjust height of a foot end of the bed; and, control means electrically coupled to the first and second linear actuators, the control means operable to compare position information from the first and second internal position sensors, and the control means operable to adjust power supply to the linear actuators in response to the position information for maintaining the bed in a level position while the height of the bed is being adjusted.

According to another aspect of the present invention, there is provided a height adjustable bed comprising: a frame having a head end and a foot end; first bed support means having a top end pivotally coupled to the frame and a bottom end for supporting the bed on a surface; second bed support means having a top end pivotally coupled to the frame and a bottom end for supporting the bed on the surface; a first electrically powered linear actuator having a first internal position sensor, the first linear actuator coupled to the first bed support means and operable to adjust height of the head end in relation to the surface by urging the first bed support means to pivot at its top end; a second electrically powered linear actuator having a second internal position sensor, the second linear actuator coupled to the second bed support means and operable to adjust height of the foot end in relation to the surface by urging the second bed support means to pivot at its top end; and, control means electrically coupled to the first and second linear actuators, the control means operable to compare position information from the first and second internal position sensors, and the control means operable to adjust power supply to the linear actuators in response to the position information for maintaining the bed in a level position while the height of the bed is being adjusted.

Electrically powered linear actuators are generally known in the art and are known to be used on height adjustable patient beds to adjust the height of the bed. U.S. Patent Publication 2003/0172459 in the name of Richard Roussy published Sep. 18, 2003, the disclosure of which is herein incorporated by reference, is one example of a height adjustable bed employing electrically powered linear actuators to adjust the height of the bed.

An electrically powered linear actuator generally comprises a reversible electric motor and a piston rod coupled to the electric motor through a gearing system. The gearing system generally comprises a lead screw, which rotates under the influence of the motor. Rotation of the lead screw results in extension or retraction of the piston rod depending on the direction of rotation of the lead screw which depends upon the direction in which the motor is being driven. Since the piston rod is coupled to a bed support means, extension and retraction of the piston rod leads to height adjustment of the bed by virtue of the action of the piston rod on the bed support means. The electric motor may be either AC or DC, although DC motors are preferred.

A linear actuator useful in the present invention is equipped with an internal position sensor. The internal position sensor is located within the workings of the linear actuator itself. Any suitable internal position sensor may be used. In one embodiment, position sensing may be accomplished by counting a regularly occurring event of the linear actuator during height adjustment of the bed. The number of counts is managed by the control means and is related to the position of the bed. Preferably, counts may be based on rotation of a rotational element of the linear actuator, for example, the lead screw. The control means keeps track of the number of revolutions of the lead screw of each linear actuator and compares the number of counts between the first and second linear actuators to determine whether one end of the bed is getting ahead of the other end.

A particularly useful example of an internal position sensor is one comprising a Reed switch proximal a magnet. When a pole of the magnet passes the Reed switch, the Reed switch is opened or closed. The opening and closing of the Reed switch generates a pulse count, which is used as positional information for processing by the control means. The magnet is preferably a multi-pole magnet, for example an eight-pole magnet. The magnet is preferably a doughnut magnet.

The magnet is preferably capable of being moved so that the poles of the magnet pass the Reed switch. The magnet is preferably coupled to a rotational element of the linear actuator, for example the lead screw. In this case, the rotational element provides for movement of the magnet so that successive poles of the magnet would pass the Reed switch to thereby cause the Reed switch to open and close thus generating the pulse count. From the pitch of the lead screw (typically about 4 mm), stroke distance of the linear actuator and therefore the height of the bed can be correlated to the pulse count generated by the internal position sensor. A deviation in pulse counts between the linear actuators can be correlated to a difference in height between the ends of the bed. The deviation in pulse counts can then be used as a parameter for the control means to determine whether power adjustment to one of the linear actuators is required to permit the other to catch up and maintain the level of the bed. In practice, the amount of permissible deviation is pre-selected. When the pulse count of one linear actuator deviates from the pulse count of the other linear actuator by a value greater that the pre-selected amount, the control means switches off the motor of the linear actuator having the greater pulse count until the deviation is rectified, at which time, the control means switches the motor back on. One pulse count, i.e. one opening and closing of the Reed switch, correlates to a very small positional change in the height of the bed and the pre-selected amount of deviation is generally chosen to be relatively small (e.g. about 4 pulse counts). As a result, the linear actuators turn off and on very quickly when making corrections for bed level. In this manner, very fine control of bed level is permitted. Thus, there is no noticeable tilt of the bed during height adjustment of the bed and the bed operates more smoothly during height adjustment of the bed.

Errors in the pulse counts of the linear actuators may accumulate over time, especially when the bed is being lowered. The control means knows which way the bed is being driven by virtue of the polarity in the wires to the motor. When power to the motor is turned off, pulse counting stops but momentum of the lead screw may carry a pole or poles of the magnet further resulting in one or more unregistered counts. Accumulation of counting errors over time can be significant, therefore, the pulse counts of the linear actuator are preferably periodically reset to zero. Resetting the pulse counts to zero may be accomplished by establishing a home position. When the linear actuator is in the home position the pulse count is automatically set to zero. For convenience, the home position is set to when the linear actuator is fully retracted, which conveniently corresponds to a lowermost position of the bed. In one embodiment, a limit switch is triggered as the linear actuator reaches the fully retracted position, which interrupts power to the motor even though a down button on a control panel is still being depressed. This provides a signal to the control means to reset the pulse count to zero.

The control means is electrically coupled to the linear actuators by a wire or wires or wirelessly. The control means preferably comprises a microprocessor or microprocessors having software therein. The control means records and compares pulse counts from the internal position sensors of the linear actuators. In response to the pulse count comparison, the control means can adjust power supply to various elements of the linear actuators, including the motors. The control means may be separate from or part of other electrical controls for other functions of the bed.

A height adjustable bed in accordance with the present invention comprises a frame having a head end and a foot end. Mounted on the frame there may be a patient support platform, which supports a mattress and ultimately the patient. The patient support platform may comprise back and knee portions, which are movable to provide different positions in which the patient may repose. The frame is supported on a surface, such as the floor, by bed support means, for example leg structures. In one embodiment, the bed comprises two bed support means, each having a top end pivotally coupled to the frame and a bottom end for supporting the bed on the surface. The bottom end may be provided with feet, casters, foot/caster arrangements or any other suitable surface engaging means.

The linear actuators are coupled to the bed support means. One linear actuator is operable to adjust the height of the head end of the bed by urging one of the bed support means to pivot at its top end. In addition to the top end pivoting, the top end and/or the bottom end of the bed support means translates along a direction parallel to the frame and the surface. As a result, the height of the head end above the surface will change. In a similar manner, the other linear actuator is operable to adjust the height of the foot end of the bed by urging the other bed support means to pivot at its top end.

In a preferred embodiment, the top end of the bed support means both pivots and translates, with the bottom end remaining in a fixed location on the surface. In such an embodiment, the bed support means may be pivotally attached to a bed support bearing structure, which is movably mounted on the frame. The bed support bearing structure is coupled to the linear actuator and moves along the frame as a result of the action of the linear actuator to thereby translate the top end of the bed support means. The height of the bed is thereby adjusted since the bottom end of the bed support means remains in the fixed location on the surface.

The system of the present invention is particularly advantageous when the height of an unevenly loaded bed is being adjusted. Uneven loading on the bed causes the motor in one of the linear actuators to turn more slowly than the other. Since there is a direct relationship between motor speed and rate of height adjustment of the bed, one end of the bed quickly lags behind the other end during height adjustment of an unevenly loaded bed. The system of the present invention provides effective, non-noticeable leveling of the bed during height adjustment despite extreme differences in loading of one end of the bed to the other.

Further features of the invention will be described or will become apparent in the course of the following detailed description.

BRIEF DESCRIPTION OF THE DRAWINGS

In order that the invention may be more clearly understood, embodiments thereof will now be described in detail by way of example, with reference to the accompanying drawings, in which.

DESCRIPTION OF PREFERRED EMBODIMENTS

Figure 1:
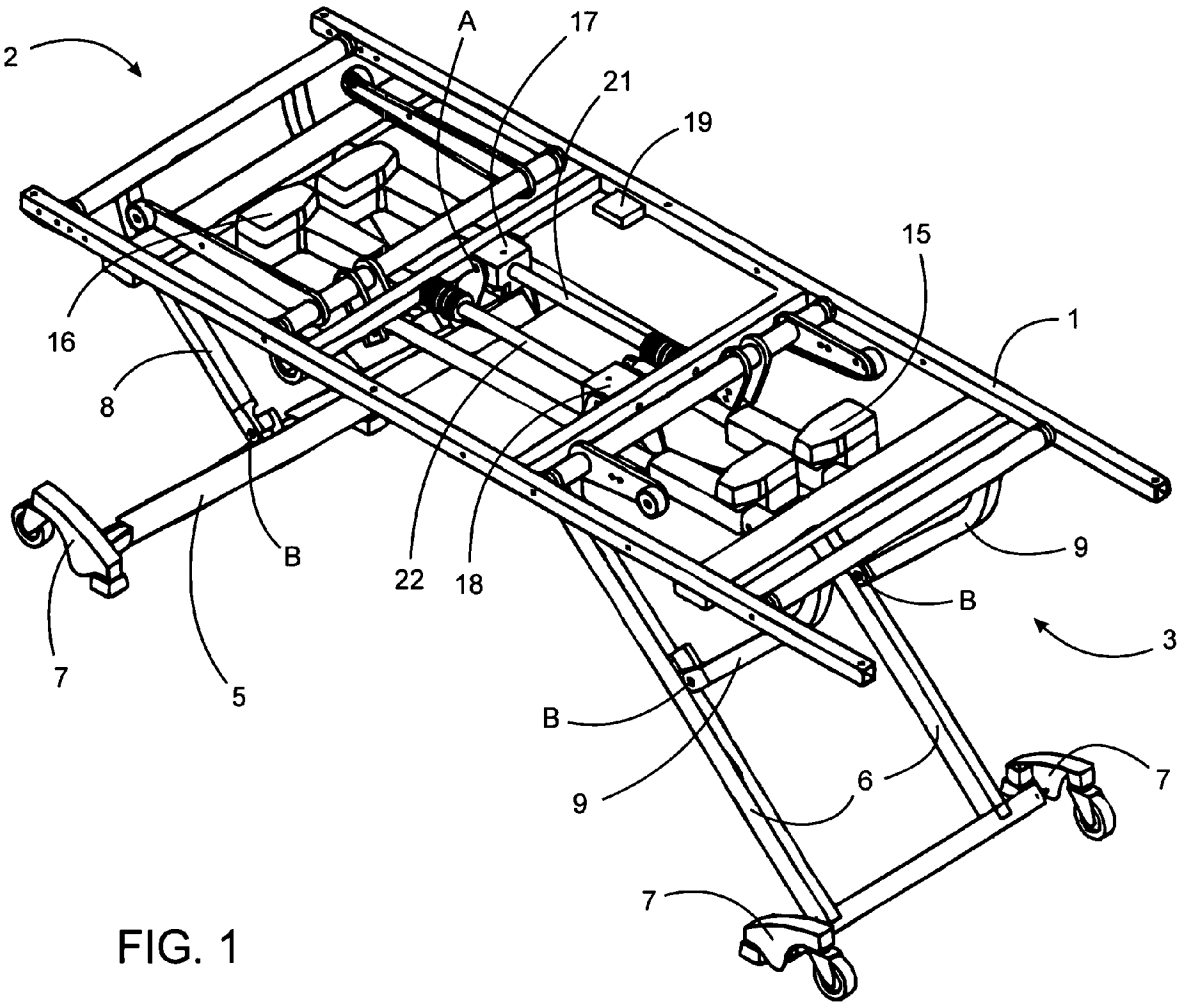
FIG. 1 is a perspective view of a height adjustable bed having a leveling system of the present invention.

Referring to FIG. 1, a height adjustable bed having a leveling system of the present invention is depicted. The bed comprises a frame 1 having a head end generally depicted at 2 and a foot end generally depicted at 3. A set of downwardly depending head end legs 5 are pivotally attached to a head end bearing block 17 at a point A at a top of the head end legs 5. A set of downwardly depending foot end legs 6 are pivotally attached to a foot end bearing block 18 in a similar manner as the head end legs are attached to the head end bearing block. The head end bearing block 17 has a circular aperture therethrough so that it may move along a first linear guide 21 by action of a first linear actuator 15 coupled to the bearing block 17. The foot end bearing block 18 has a circular aperture therethrough so that it may move along a second linear guide 22 by action of a second linear actuator 16 coupled to the bearing block 18. Movement of the head end bearing block 17 causes the top of the head end legs 5 to pivot at point A and to move with the bearing block. Since the foot/caster arrangements 7 supporting each of the legs 5,6 on the floor do not change location, pivoting and translation of the top of the head end legs 5 causes the height of the head end 2 of the bed to change. A similar description involving the foot end legs 6 and foot end bearing block 18 applies to the foot end 3 of the bed. Head end linkage arms 8 (only one shown) and foot end linkage arms 9 are pivotally attached to their respective legs at points B and pivotally attached to the frame. The linkage arms provide structural stability to the legs.

Still referring to FIG. 1, actuator control box 19 comprising microprocessors is mounted on the frame 1 and is electrically connected to the various electrical features of the bed including the linear actuators 15,16 by wires (not shown). The actuator control box 19 is also connected to a power supply (not shown) which may be building mains, a back-up battery or both. An electrical schematic of the leveling system including the actuator control box 19 is described below in connection with FIG. 2.

Figure 2:
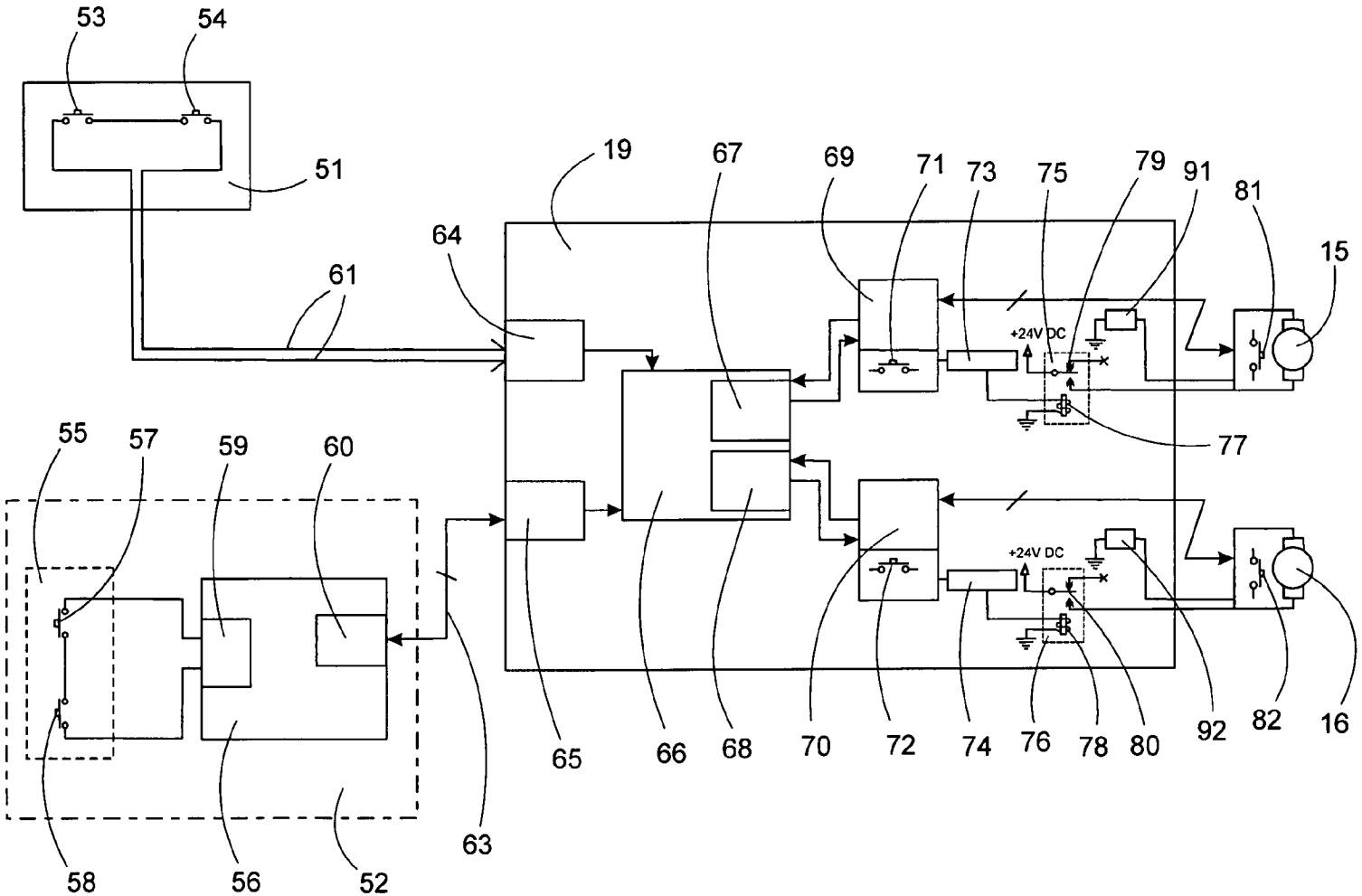
FIG. 2 is an electrical schematic of the leveling system used with the bed of FIG. 1.

FIG. 2 depicts an electrical schematic of the leveling system used with the bed of FIG. 1. Up and down control of the bed can be effected from either a hand pendant 51 or a foot board staff control 52. The hand pendant 51 comprises, among other elements (not shown), two momentary contact switches, a first up switch 53 and a first down switch 54. The foot board staff control 52 comprises a keypad 55 and a keypad microcontroller 56. The keypad 55 comprises, among other elements (not shown), a second up switch 57 and a second down switch 58. The keypad microcontroller 56 comprises, among other elements (not shown), a button decoder 59 and a first UART serial port 60. Two wires 61 electrically connect the hand pendant to an up/down decoder 64 in the actuator control box 19. A cable 63 electrically connects the foot board staff control 52 to a second UART serial port 65 in the actuator control box 19. Activating the first up switch 53 or the first down switch 54 on the hand pendant 51 sends a signal through one of the wires 61 to the up/down decoder 64 which determines which switch was activated. Activating the second up switch 57 or the second down switch 58 on the keypad 55 sends a signal to the button decoder 59 which determines which switch was activated. A signal is then sent from the button decoder 59 to the first UART serial port 60 and thence to the second UART serial port 65 via a wire in the cable 63.

In the actuator control box 19, signal from either the up/down decoder 64 or the second UART serial port 65 is sent to the actuator microcontroller 66. The actuator microcontroller 66 comprises, among other elements (not shown), a first position memory 67 and a second position memory 68. From the microcontroller 66, the signal is sent to first and second counters 69,70 thereby closing first and second counter switches 71,72. The signal passes to first and second NPN transistors 73,74 which power first and second coils 77,78 of first and second relays 75,76. Powering the coils 77,78 activates armatures, which pull down on contacts 79,80 thereby permitting 24V DC power to flow to the first and second linear actuators 15,16. Field effect transistors 91,92 momentarily keep the circuit open when the contacts 79,80 close in order to prevent arcing in the contacts. As the motors in the first and second linear actuators 15,16 rotate, first and second Reed switches 81,82 open and close in a manner as described below. Opening and closing of the Reed switches 81,82 sends signals back to the first and second counters 69,70 and pulse counts generated by the counters 69,70 are stored in the first and second position memories 67,68. The actuator microcontroller 66 is programmed to compare the difference in pulse counts between the position memories.

Under conditions of balanced load on the bed, pulse counts in the two position memories remain close together (e.g. within 5 pulse counts of each other) and the electrical system behaves as described above. However, when one end of the bed bears a greater load than the other, the linear actuator at the end having the greater load must do more work and therefore lags behind the linear actuator at the other end. For example, when a patient is lying in the bed, the head end of the bed bears a greater load and the first linear actuator 15 lags behind the second linear actuator 16. In this situation, the number of pulse counts stored in the first position memory 67 becomes fewer than in the second position memory 68. When the actuator microcontroller 66 determines that the difference in pulse counts is greater than 5, the actuator microcontroller 66 sends a signal to the second counter switch 72 to open thereby cutting power to the second linear actuator 16. The motor of the second linear actuator 16 stops running so no more pulse counts are counted. Since the motor of the first linear actuator 15 continues to run, pulse counts in the first position memory 67 rise. When the pulse count difference between the position memories 67,68 is less than 5, the actuator microcontroller 66 sends a signal to the second counter switch 72 to close thereby re-powering the second linear actuator 16 which re-starts the pulse counts in the second position memory 68. Since 5 pulse counts represents only a partial turn of a linear actuator, the linear actuator turns off and on so quickly that there is no noticeable tilt or jerkiness during height adjustment of the bed. During the period of time in which the motor is off, the linear actuator actually doesn't completely stop turning due to momentum thereby contributing an overall smoothness of action. It is one important benefit that the self-leveling system can control the level of the bed without any noticeable tilt or jerkiness during height adjustment of the bed.

A similar description as above can be applied to a situation where the foot end of the bed is more heavily loaded, the difference being that the first linear actuator 15 rather than the second linear actuator 16 is switched off when the pulse count difference exceeds 5. One skilled in the art will realize that any pulse count difference may be programmed into the actuator microcontroller 66. As indicated previously, it is desirable to occasionally re-set the pulse counts to zero in both position memories 67,68, which is accomplished by lowering the bed to its lowermost position.

Figure 3:
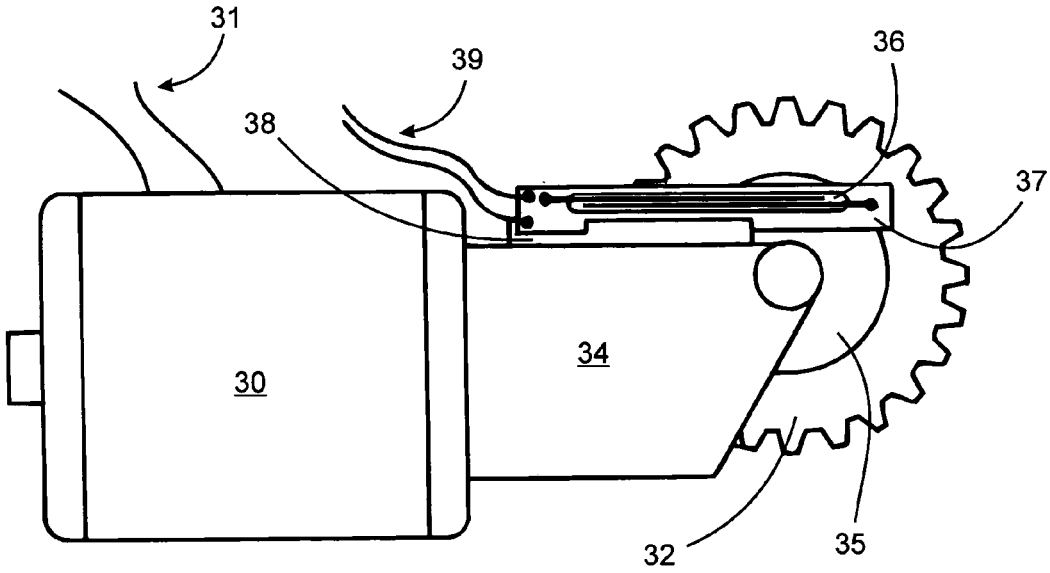
FIG. 3 is a schematic diagram of a part of a linear actuator used in the system of FIG. 2 showing an internal position sensor; and, FIG. 4 is a schematic diagram of a Reed switch used in the internal position sensor depicted in FIG. 3.

Referring to FIG. 3, one of the internal position sensors referred to in respect of FIG. 2 is shown in context with other elements of the linear actuator. The internal position sensor comprises a Reed switch 36 proximal an eight-pole doughnut magnet 35. The magnet 35 is mounted within and concentric with a bevel gear 32. The bevel gear 32 drives the lead screw of the linear actuator which drives a piston rod which in turn urges pivoting and translation of the legs which results in height adjustment of the bed. The bevel gear 32 is driven by a worm gear (not shown) and the worm gear is driven by a reversible DC motor 30. The Reed switch is mounted on a Reed switch mount 37, which is mounted on to a gear support 34 by a bracket 38. The Reed switch 36 is electrically coupled to the actuator microcontroller (not shown) by wires 39. The motor 30 is electrically coupled to the limit switches (not shown) by wires 31. In operation, the motor 30 drives a worm gear (not shown) which drives the bevel gear 32. The bevel gear 32 drives the lead screw, and the magnet 35 rotates with the rotation of the bevel gear 32 and the lead screw. Passage of the poles of the magnet 35 in proximity to the Reed switch 36 causes metal contacts in the Reed switch to open and close which generates a signal carried by wires 39 to the actuator microcontroller. The Reed switch 36 is described in more detail with reference to FIG. 4.

Figure 4:
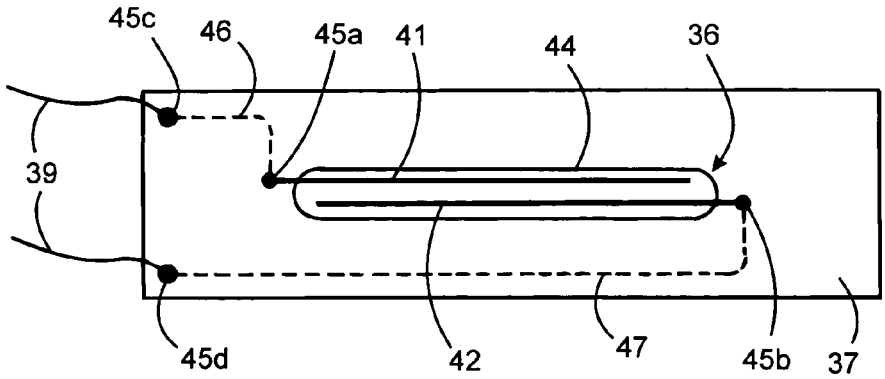

Referring to FIG. 4, the Reed switch 36 comprises a pair of ferromagnetic metal contacts 41,42 aligned in proximity to and parallel with each other inside a glass housing 44 mounted on the Reed switch mount 37. An end of metal contact 41 protrudes through the glass housing 44 to be connected to a connecting wire 46 at electrical contact 45*a*. Similarly, an end of metal contact 42 protrudes through the glass housing 44 to be connected to a connecting wire 47 at electrical contact 45*b*. Connecting wire 46 connects electrical contact 45*a* with electrical contact 45*c*. Connecting wire 47 connects electrical contact 45*b* with electrical contact 45*d*. The wires 39 leading to the actuator microcontroller (not shown) are connected to electrical contacts 45*c* and 45*d*. When one pole of the magnet passes proximal the Reed switch, metal contacts 41,42 are forced together completing a circuit. When the opposing pole of the magnet passes proximal the Reed switch, metal contacts 41,42 are forced apart breaking the circuit. The successive passage of one pole and one opposing pole is counted as one pulse count by the actuator microcontroller. A full revolution of the magnet results in eight pulse counts.

Other advantages which are inherent to the structure are obvious to one skilled in the art. The embodiments are described herein illustratively and are not meant to limit the scope of the invention as claimed. Variations of the foregoing embodiments will be evident to a person of ordinary skill and are intended by the inventor to be encompassed by the following claims.

What is claimed is:

1. A system for maintaining a height adjustable patient bed in a level position while adjusting height of the bed, the system comprising:

(a) a first electrically powered linear actuator having a first internal position sensor, the first linear actuator operable to adjust height of a head end of the bed;

(b) a second electrically powered linear actuator having a second internal position sensor, the second linear actuator operable to adjust height of a foot end of the bed; and, (c) control means electrically coupled to the first and second linear actuators, the control means operable to compare position information from the first and second internal position sensors, and the control means operable to adjust power supply to the linear actuators in response to the position information for maintaining the bed in a level position while the height of the bed is being adjusted.

2. The system of claim 1, wherein the position information is based on counting a regularly occurring event of the linear actuators.

3. The system of claim 1, wherein the position information is based on rotation of a lead screw of the linear actuators.

4. The system of claim 1, wherein the first and second internal position sensors each comprise a Reed switch proximal a magnet.

5. The system of claim 4, wherein the position information is a pulse count generated by opening and closing of the Reed switch in response to passing of a pole of the magnet.

6. The system of claim 5, wherein the magnet is a multi-pole doughnut magnet coupled to a rotational element of the linear actuators.

7. The system of claim 5, wherein the pulse count for the first linear actuator is reset to zero when the first linear actuator is fully retracted, and the pulse count for the second linear actuator is reset to zero when the second linear actuator is fully retracted.

8. The system of claim 1, wherein the first and second linear actuators each comprise a DC motor.

9. A height adjustable bed comprising:

(a) a frame having a head end and a foot end;

(b) first bed support means having a top end pivotally coupled to the frame and a bottom end for supporting the bed on a surface;

(c) second bed support means having a top end pivotally coupled to the frame and a bottom end for supporting the bed on the surface;

(d) a first electrically powered linear actuator having a first internal position sensor, the first linear actuator coupled to the first bed support means and operable to adjust height of the head end in relation to the surface by urging the first bed support means to pivot at its top end;

(e) a second electrically powered linear actuator having a second internal position sensor, the second linear actuator coupled to the second bed support means and operable to adjust height of the foot end in relation to the surface by urging the second bed support means to pivot at its top end; and, (f) control means electrically coupled to the first and second linear actuators, the control means operable to compare position information from the first and second internal position sensors, and the control means operable to adjust power supply to the linear actuators in response to the position information for maintaining the bed in a level position while the height of the bed is being adjusted.

10. The bed of claim 9, wherein the position information is based on counting a regularly occurring event of the linear actuators.

11. The bed of claim 9, wherein the position information is based on rotation of a lead screw of the linear actuators.

12. The bed of claim 9, wherein the first and second internal position sensors each comprise a Reed switch proximal a magnet.

13. The bed of claim 12, wherein the position information is a pulse count generated by opening and closing of the Reed switch in response to passing of a pole of the magnet.

14. The bed of claim 13, wherein the magnet is a multi-pole doughnut magnet coupled to a rotational element of the linear actuators.

15. The bed of claim 14, wherein the pulse count for the first linear actuator is reset to zero when the first linear actuator is fully retracted, and the pulse count for the second linear actuator is reset to zero when the second linear actuator is fully retracted.

16. The bed according to claim 15, wherein the linear actuators are fully retracted when the bed is in a lowermost position.

17. The bed of claim 13, wherein the first and second linear actuators each comprise a DC motor.

18. The bed of claim 17, wherein a deviation by a pre-selected amount in the pulse counts between the first and second linear actuators causes the control means to switch off the motor of the linear actuator having a greater pulse count until the deviation is rectified.

* * * * *